US012662774B2

(12) United States Patent
Zhu et al.

(10) Patent No.: US 12,662,774 B2
(45) Date of Patent: Jun. 23, 2026

(54) METHOD FOR PRODUCING LAYERED STEEL CORD

(71) Applicant: Jiangsu Xingda Steel Tyre Cord Co., Ltd., Taizhou (CN)

(72) Inventors: Chenlu Zhu, Taizhou (CN); Zifei Ni, Taizhou (CN); Shoupeng Kou, Taizhou (CN); Na Li, Taizhou (CN)

(73) Assignee: Jiangsu Xingda Steel Tyre Cord Co., Ltd. (CN)

( * ) Notice: Subject to any disclaimer, the term of this patent is extended or adjusted under 35 U.S.C. 154(b) by 0 days.

(21) Appl. No.: 19/102,766

(22) PCT Filed: Jun. 5, 2023

(86) PCT No.: PCT/CN2023/098202
§ 371 (c)(1),
(2) Date: Feb. 10, 2025

(87) PCT Pub. No.: WO2024/239377
PCT Pub. Date: Nov. 28, 2024

(65) Prior Publication Data

US 2026/0071382 A1 Mar. 12, 2026

(30) Foreign Application Priority Data

May 23, 2023 (CN) ..... 202310580757.1

(51) Int. Cl.
*D07B 1/06* (2006.01)
*D07B 5/00* (2006.01)

(52) U.S. Cl.
CPC ..... *D07B 5/007* (2013.01); *D07B 1/0613* (2013.01); *D07B 1/062* (2013.01); *D07B 1/0646* (2013.01);

(Continued)

(58) Field of Classification Search
CPC ..... D07B 1/0646; D07B 2201/102; D07B 2201/104; D07B 2205/3025
See application file for complete search history.

(56) References Cited

U.S. PATENT DOCUMENTS 2,423,996 A * 7/1947 Rubel ..... D05B 71/04 112/281
3,699,768 A * 10/1972 Roberts ..... D07B 1/0633 57/244

(Continued)

FOREIGN PATENT DOCUMENTS

CN 1130929 A * 9/1996 ..... D07B 1/0686
JP 2004277968 A * 10/2004 ..... D07B 5/005

(Continued)

*Primary Examiner* — Tajash D Patel

(57) ABSTRACT

Provided is a method for producing a layered steel cord and belongs to the technical field of steel cord production. The method includes: prestressing some of steel filaments in each layer other than a core wire to obtain prestressed steel filaments; and arranging conventional steel filaments and the prestressed steel filaments in each layer alternately in a stranding machine and performing twisting to obtain the layered steel cord. In the prior art, during the twisting process of a steel cord, due to the residual stress of a steel filament itself and the fluctuation of the tension during the unwinding process, a layered steel cord has a problem of a large interlayer residual stress. The methods controls the stress distribution state of a twisted layered steel cord by prestressing steel filaments, and avoids unflatness of a cord fabric during calendering and warping during cutting in the production process of tires.

12 Claims, 2 Drawing Sheets

(52) U.S. Cl.
CPC .. *D07B 2201/102* (2013.01); *D07B 2201/104* (2013.01); *D07B 2201/2009* (2013.01); *D07B 2205/3025* (2013.01)

(56) References Cited

U.S. PATENT DOCUMENTS 5,911,675 A * 6/1999 Obana ..... D07B 1/064 57/902
12,247,352 B2 * 3/2025 Liu ..... B60C 9/0007

FOREIGN PATENT DOCUMENTS

WO WO-2015193099 A1 * 12/2015 ..... D07B 1/0646
WO WO-2018092534 A1 * 5/2018 ..... D07B 1/062
WO WO-2019069560 A1 * 4/2019 ..... B60C 9/0007

* cited by examiner

METHOD FOR PRODUCING LAYERED STEEL CORD

FIELD

The present invention relates to the technical field of steel cord production and, in particular, to a method for producing a layered steel cord.

BACKGROUND

During the twisting process of a steel cord, the residual stress of a steel filament itself and the fluctuation of the tension during the unwinding process have a great influence on the stress distribution state of the steel cord. If the stress distribution is seriously uneven, it will adversely affect the quality of the steel cord. During the production process of tires, the cord fabric will become ridgy during calendering and warping occurs during cutting, even leading to a failure for continue production. This phenomenon is not that serious during the production of cords with a simple structure. However, in the production of complex layered cords, it has a great influence, so it is very important to control the stress distribution of the steel cord during the twisting process.

SUMMARY

An objective of the present invention is to overcome the shortcomings of the prior art and provide a method for producing a layered steel cord, and solve the problem that in the prior art, a layered steel cord has a large interlayer residual stress due to the residual stress of a steel filament itself and the fluctuation of the tension during the unwinding process.

To achieve the above objective, the present invention is implemented by the following technical solution:

In a first aspect, the present invention provides a method for producing a layered steel cord, including: obtaining prestressed steel filaments; and arranging conventional steel filaments and the prestressed steel filaments in each layer alternately in a stranding machine, and twisting the steel filaments around a core wire to obtain the layered steel cord.

In combination with the first aspect, further, the obtaining prestressed steel filaments includes prestressing some of steel filaments in each layer other than the core wire by a prestressing device, wherein the prestressing device includes a straightener and an overtwister.

In combination with the first aspect, further, the prestressing includes: performing the operation of prestressing on a filament production water tank to prestress the steel filaments.

In combination with the first aspect, further, the prestressing also includes performing the operation of prestressing before a twisting point of the stranding machine to prestress the steel filaments.

In combination with the first aspect, further, the number of prestressed steel filaments is at least one.

In combination with the first aspect, further, the arranging conventional steel filaments and the prestressed steel filaments in each layer alternately in a stranding machine and twisting the steel filaments around a core wire further includes: during the twisting process, controlling an interlayer stress state, wherein the interlayer stress state is characterized by a sum of absolute values of the stress states of all layers, and the stress state of each layer is characterized by an algebraic sum of the residual torsion of the steel filaments in the layer divided by the number of steel filaments in the layer.

In combination with the first aspect, further, the controlling the interlayer stress state includes: controlling the number of turns of interlayer twist to be 0-1.5 turns, preferably 0-1 turn.

In a second aspect, the present invention provides a layered steel cord produced by the production method described in any one of solutions in the first aspect, wherein the layered steel cord comprises a core wire, conventional steel filaments and prestressed steel filaments; the core wire is located in the center, and the conventional steel filaments and the prestressed steel filaments are arranged alternately around the core wire.

Compared with the prior art, the present invention achieves the following beneficial effects:

The present invention discloses a method for producing a layered steel cord, including: prestressing some of steel filaments in each layer other than a core wire to obtain prestressed steel filaments; and arranging conventional steel filaments and the prestressed steel filaments in each layer alternately in a stranding machine and performing twisting to obtain the layered steel cord. The present invention controls the stress distribution state of the twisted layered steel cord by prestressing the steel filaments, thereby avoiding unflatness of the cord fabric during calendering and warping during cutting in the production process of tires.

where, 1. core wire; 2. prestressed steel filament; 3. conventional steel filament.

DETAILED DESCRIPTION

The technical solution of the invention is described in detail below in conjunction with the accompanying drawings and specific embodiments. It should be understood that the embodiments of the present application and the specific features in the embodiments are detailed descriptions of the technical solution of the present application, rather than limitations on the technical solution of the present application. In the absence of conflict, the embodiments of the present application and the technical features in the embodiments can be combined with each other.

The term "and/or", as used herein, is only a description of the association relationship of the associated objects and indicates that there may be three relationships. For example, A and/or B may represent: A exists alone, A and B exist at the same time, and B exists alone. In addition, the character "/", as used herein, generally indicates that the objects associated with each other are in an "or" relationship.

Embodiment 1

Figure 1:
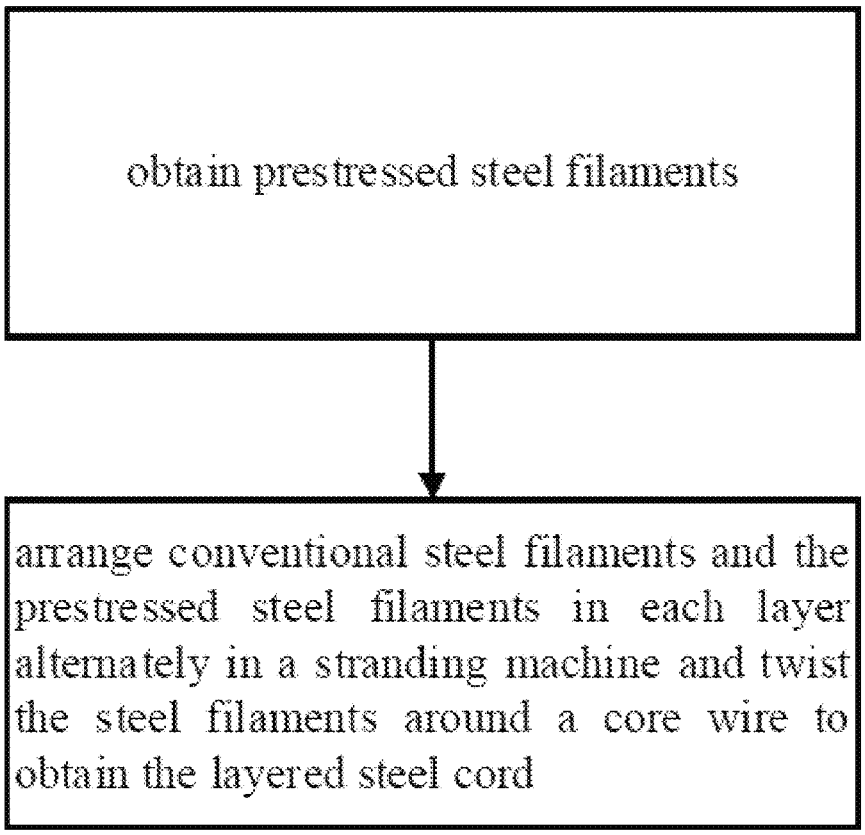
FIG. 1 is a flow chart of a method for producing a layered steel cord provided in Embodiment 1 of the present invention.

As shown in FIG. 1, this embodiment provides a method for producing a layered steel cord, including the following steps:

Step 1: obtaining prestressed steel filaments 2.

Some of steel filaments in each layer other than a core wire are prestressed by a prestressing device, wherein the prestressing device includes a straightener and an overtwister, and the overtwister is preferred. The operation of prestressing may be performed on a filament production water tank or before the twisting point of a stranding machine to prestress steel filaments to obtain the prestressed steel filaments 2. The number of prestressed steel filament is at least one.

Step 2: arranging conventional steel filaments 3 and the prestressed steel filaments 2 in each layer alternately in a stranding machine, and twisting the steel filaments around the core wire to obtain the layered steel cord.

The locations of the prestressed steel filaments 2 and the conventional steel filaments 3 in the stranding machine are allocated so that in the twisted layered steel cord, in each layer of steel filaments other than the core wire 1, the conventional steel filaments 3 and the prestressed steel filaments 2 are arranged alternately.

It should be noted that if the number of steel filaments in each layer of the layered steel cord is an odd number, there will be two conventional steel filaments 3 or two prestressed steel filaments 2 arranged adjacent to each other in each layer, and this arrangement does not affect the structure of the layered steel cord.

It should be noted that during twisting, it is required to control the interlayer stress state so that the accumulated residual stress state of all steel filaments in the layer is close to 0 and the sum of absolute values of stress states between the layers other than the core wire 1 is close to 0, thereby controlling the stress distribution state of the entire steel cord. wherein the interlayer stress state is characterized by a sum of absolute values of the stress states of all layers, and the stress state of each layer is characterized by an algebraic sum of the residual torsion of the steel filaments in the layer divided by the number of steel filaments in the layer.

In the twisted layered steel cord, the stress state of steel filaments in each layer, the stress state of each layer, and the interlayer stress state are characterized as follows:

The stress of steel filaments in each layer is quantified by testing the residual torsion over a length of one meter. Clockwise is positive, counterclockwise is negative, and a quarter turn of twist is 0.25 turns. If the number of turns is less than 0.25 turns but more than 0.125 turns, it is counted as 0.25 turns. Otherwise, it is counted as 0. The stress state of each layer is characterized by an algebraic sum of the residual torsion of the steel filaments in the layer divided by the number of steel filaments in the layer. The interlayer stress state is characterized by a sum of absolute values of the stress states of all layers. During twisting, the interlayer stress state needs to be controlled. That is, the number of turns of interlayer twist is controlled to be 0-1.5 turns, preferably 0-1 turn.

Embodiment 2

Figure 2:
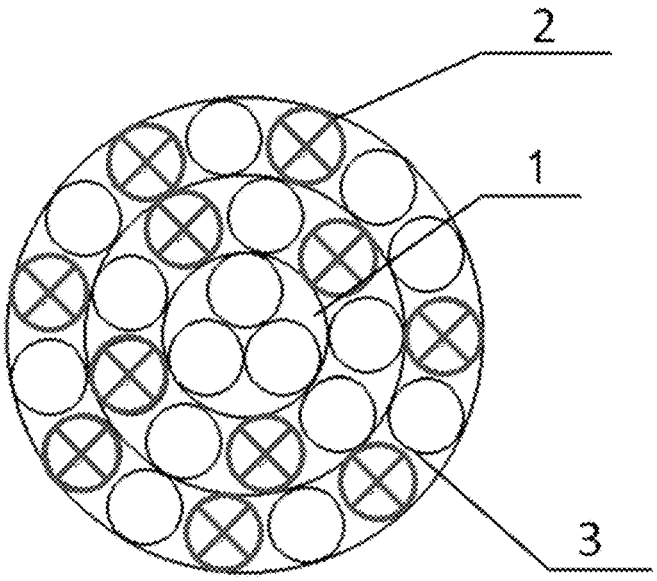
FIG. 2 is a schematic cross-sectional structural diagram of a layered steel cord provided in Embodiment 2 of the present invention.

As shown in FIG. 2, this embodiment provides a layered steel cord, which is produced by the production method provided in Embodiment 1, and the layered steel cord comprises core wires 1 located in the center, conventional steel filaments 3, and prestressed steel filaments 2. The core wires 1 are located in the center, and the conventional steel filaments 3 and the prestressed steel filaments 2 are arranged alternately around the core wires 1. In this structure, the number of steel filaments in each layer other than the core wires 1 is an odd number, there are two conventional steel filaments 3 arranged adjacent to each other in each layer, and this arrangement does not affect the structure of the layered steel cord.

Embodiment 3

Figure 3:
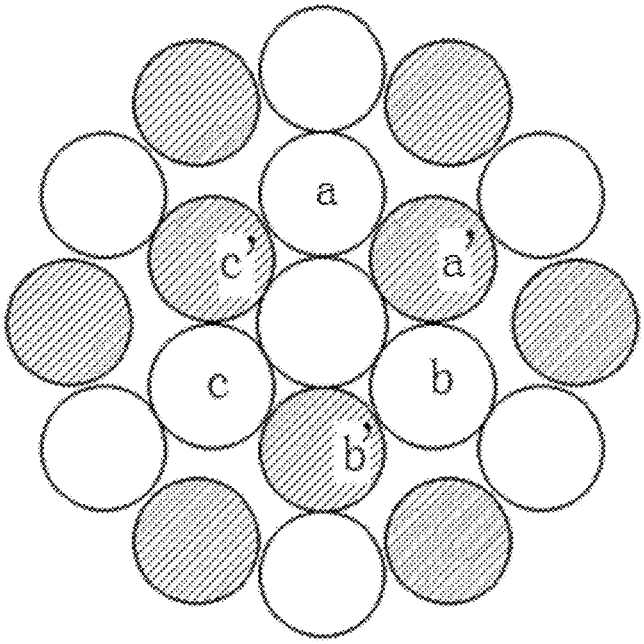
FIG. 3 is a schematic diagram of arrangement of middle-layer steel filaments in a steel cord with a 1+6+12 structure provided in Embodiment 3 of the present invention.
Figure 4:
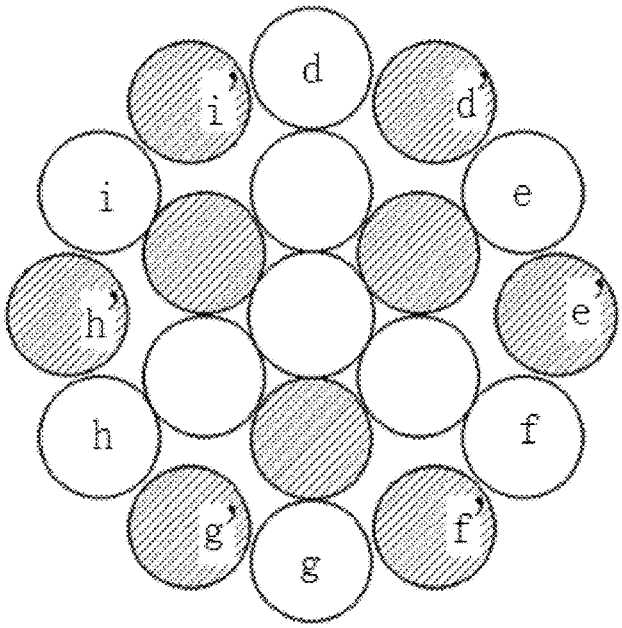
FIG. 4 is a schematic diagram of arrangement of outer-layer steel filaments in the steel cord with a 1+6+12 structure provided in Embodiment 3 of the present invention.

As shown in FIGS. 3-4, this embodiment provides a specific embodiment of a layered steel cord, which is produced by the production method provided in Embodiment 1.

The steel cord produced in this embodiment is a steel cord with a 1+6+12 structure, with a core wire 1 located in the center, and a total of six steel filaments in the middle layer, of which three steel filaments are prestressed steel filaments 2, and the other three steel filaments are conventional steel filaments 3. The six steel filaments are arranged in order as follows: conventional steel filament a, prestressed steel filament a', conventional steel filament b, prestressed steel filament b', conventional steel filament c, prestressed steel filament c'. That is, the conventional steel filaments 3 and the prestressed steel filaments 2 are arranged alternately. There are twelve steel filaments in the outer layer, six of which are prestressed steel filaments 2 and the other six are conventional steel filaments 3. The arrangement rule of the twelve steel filaments is consistent with the arrangement rule of steel filaments in the middle layer and the twelve steel filaments are arranged as follows: conventional steel filament d, prestressed steel filament d', conventional steel filament e, prestressed steel filament e', conventional steel filament f, prestressed steel filament f, conventional steel filament g, prestressed steel filament g', conventional steel filament h, prestressed steel filament h', conventional steel filament i, prestressed steel filament i'. That is, conventional steel filaments 3 and prestressed steel filaments 2 are arranged alternately. The stress characterization of the steel cord with a 1+6+12 structure is carried out. Table 1 shows the test results of residual torsion of the middle-layer steel filaments in the steel cord with a 1+6+12 structure, and Table 2 shows the test results of residual torsion of the outer-layer steel filaments in the steel cord with a 1+6+12 structure.

TABLE 1

Residual torsion of middle-layer steel filaments in the steel cord with a 1 + 6 + 12 structure

| | Conventional steel filament a | Prestressed steel filament a' | Conventional steel filament b | Prestressed steel filament b' | Conventional steel filament c | Prestressed steel filament c' | Algebraic sum | Residual stress of this layer |
|---|---|---|---|---|---|---|---|---|
| Twist/turn | −0.75 | 1 | −0.5 | 0.5 | −0.75 | 1.0 | 0.5 | 0.5/6 |

TABLE 2

| Residual torsion of outer-layer steel filaments in the steel cord with a 1 + 6 + 12 structure | | | | | | | |
|---|---|---|---|---|---|---|---|
| | Conventional steel filament d | Prestressed steel filament d' | Conventional steel filament e | Prestressed steel filament e' | Conventional steel filament f | Prestressed steel filament f' | Conventional steel filament g |
| Twist/turn | −1.0 | 1.0 | −0.75 | 1 | −1.0 | 1.25 | −0.75 |
| | Prestressed steel filament g' | Conventional steel filament h | Prestressed steel filament h' | Conventional steel filament i | Prestressed steel filament i' | Algebraic sum | Residual stress of this layer |
| Twist/turn | 1 | −0.5 | 0.5 | −0.25 | 0.5 | 0 | 0 |

According to the data in the tables, the stress state between the middle layer and the outermost layer is characterized by: the torsion between the middle layer and the outermost layer is given by 0.5/6+0=0.083 (turns), which is within the range of 0-1.0 turn. And in the calendering and cutting test, when the steel cord with a 1+6+12 structure produced by the production method provided in Embodiment 1 is calendered, the cord fabric is flat and no warping occurs during cutting.

In combination with the embodiments set forth above, the present invention discloses a method for producing a layered steel cord and a layered steel cord produced by the production method. The stress distribution state of the twisted layered steel cord is controlled by prestressing the steel filaments, thereby avoiding unflatness of the cord fabric during calendering and warping during cutting in the production process of tires.

Embodiment 4

This embodiment provides a specific embodiment of a layered steel cord used for a cord fabric, and the layered steel cord used is the same as that in Embodiment 3.

The steel cord produced in this embodiment is a steel cord with a 1+6+12 structure, which is 1.14 mm thick and the cord fabric has a thickness of 2.2 mm and 1.6 mm respectively during calendering. Compared with the conventional steel cord of the same specification without prestress, the warping height during calendering and cutting is shown in Table 3.

TABLE 3

| Comparison of warping height results of steel cord with a 1 + 6 + 12 structure during calendering and cutting | | |
|---|---|---|
| | Warping height during cutting/mm | |
| Steel cord with a 1 + 6 + 12 structure | Cord fabric thickness 2.2 mm | Cord fabric thickness 1.6 mm |
| Conventional steel cord with a 1 + 6 + 12 structure without prestress | 2 | 8 |
| Prestressed steel cord with a 1 + 6 + 12 structure of the invention | 0 | 0 |

According to the data in the table, when the cord fabric is thick, the rubber material is thick and has a greater binding effect on the steel cord. The effects of the prestressed steel cord with a 1+6+12 structure of the present invention and the steel cord with a 1+6+12 structure without prestress on the cord fabric during calendering and cutting do not differ obviously; but when the cord fabric is thin, the effects of the two steel cords on the cord fabric during calendering and cutting are quite different. When the cord fabric is thin, the prestressed layered steel cord of the present invention has a more prominent effect in controlling the flatness of the cord fabric and the warping during cutting.

The above is only preferred embodiments of the present invention. It should be pointed out that for those of ordinary skill in the art, several improvements and modifications can be made without departing from the technical principles of the present invention. These improvements and modifications should also be regarded as the scope of the present invention.

What is claimed is:

1. A method for producing a layered steel cord, comprising:

prestressing some of steel filaments in each layer other than a core wire to obtain prestressed steel filaments; and arranging steel filaments without prestressing and the prestressed steel filaments in each layer alternately in a stranding machine, and twisting the steel filaments around a core wire to obtain the layered steel cord, wherein performing the prestressing on a filament production water tank to prestress some of the steel filaments.

2. The method for producing a layered steel cord according to claim 1, wherein, performing the prestressing by a prestressing device, wherein the prestressing device comprises a straightener and an overtwister.

3. The method for producing a layered steel cord according to claim 1, wherein, performing the prestressing before a twisting point of the stranding machine to prestress the steel filaments.

4. The method for producing a layered steel cord according to claim 3, wherein, a number of the prestressed steel filaments is at least one.

5. The method for producing a layered steel cord according to claim 3, wherein, during the twisting process, controlling an interlayer stress state, wherein the interlayer stress state is characterized by a sum of absolute values of the stress states of all layers, and the stress state of each layer is characterized by an algebraic sum of a residual torsion of the steel filaments in the layer divided by a number of steel filaments in the layer.

6. The method for producing a layered steel cord according to claim 5, wherein, controlling a number of turns of interlayer twist to be 0-1.5 turns, preferably 0-1 turn.

7. A layered steel cord, being produced by the production method according to claim 1, wherein the layered steel cord comprises the core wire, the steel filaments without prestressing and the prestressed steel filaments; the core wire is located in a center, and the steel filaments without prestressing and the prestressed steel filaments are arranged alternately around the core wire.

8. The layered steel cord according to claim 7, wherein, performing the prestressing by a prestressing device, wherein the prestressing device comprises a straightener and an overtwister.

9. The layered steel cord according to claim 7, wherein, performing the prestressing before a twisting point of the stranding machine to prestress the steel filaments.

10. The layered steel cord according to claim 9, wherein, a number of the prestressed steel filaments is at least one.

11. The layered steel cord according to claim 9, wherein, during the twisting process, controlling an interlayer stress state, wherein the interlayer stress state is characterized by a sum of absolute values of the stress states of all layers, and the stress state of each layer is characterized by an algebraic sum of a residual torsion of the steel filaments in the layer divided by a number of steel filaments in the layer.

12. The layered steel cord according to claim 11, wherein controlling a number of turns of interlayer twist to be 0-1.5 turns, preferably 0-1 turn.

* * * * *